US008021273B2

(12) United States Patent
Kopp

(10) Patent No.: US 8,021,273 B2
(45) Date of Patent: Sep. 20, 2011

(54) TUMBLER APPARATUS

(75) Inventor: Todd Kopp, Newburyport, MA (US)

(73) Assignee: CoreAthletics LLC, Amesbury, MA (US)

( * ) Notice: Subject to any disclaimer, the term of this patent is extended or adjusted under 35 U.S.C. 154(b) by 0 days.

(21) Appl. No.: 12/283,289

(22) Filed: Sep. 10, 2008

(65) Prior Publication Data

US 2009/0176621 A1 Jul. 9, 2009

Related U.S. Application Data

(60) Provisional application No. 60/971,323, filed on Sep. 11, 2007, provisional application No. 60/971,330, filed on Sep. 11, 2007.

(51) Int. Cl.
*A63B 21/00* (2006.01)

(52) U.S. Cl. ..... 482/35; 482/148; 482/121; 482/77; 482/130; 297/281

(58) Field of Classification Search ..... 482/35, 482/121, 148, 130, 77; 297/271–274, 281; 446/104, 105
See application file for complete search history.

(56) References Cited

U.S. PATENT DOCUMENTS

| | | | | |
|---|---|---|---|---|
| 3,379,438 | A * | 4/1968 | Stewart | 472/105 |
| 3,495,794 | A * | 2/1970 | Polk, Jr. | 248/157 |
| 4,241,914 | A | 12/1980 | Bushnell | |
| 4,873,964 | A * | 10/1989 | Bonoan | 124/20.1 |
| 5,328,410 | A * | 7/1994 | Amburgey et al. | 472/99 |
| 5,788,606 | A | 8/1998 | Rich | |
| 5,816,983 | A * | 10/1998 | Dawes et al. | 482/78 |
| 5,873,798 | A | 2/1999 | Bostick | |
| 5,876,311 | A * | 3/1999 | Coates et al. | 482/77 |
| 6,554,747 | B1 | 4/2003 | Rempe | |
| 6,884,188 | B2 * | 4/2005 | Cherry | 473/451 |
| 2003/0073504 | A1 * | 4/2003 | Ettenhofer | 472/104 |
| 2007/0161468 | A1 | 7/2007 | Yanagisawa | |

FOREIGN PATENT DOCUMENTS

WO WO 02/087703 A2 11/2002

OTHER PUBLICATIONS

International Search Report, PCT/US2008/010572, mailing date Dec. 23, 2008.

* cited by examiner

*Primary Examiner* — Jerome W Donnelly
(74) *Attorney, Agent, or Firm* — Hamilton, Brook, Smith & Reynolds, P.C.

(57) ABSTRACT

In one embodiment, a tumbler apparatus comprises a metal roller padded with foam, a frame to give support and height to the roller and elastic bands connected at opposite ends of the roller to connect the roller to the frame. The elastic bands connect to support hooks on the frame risers.

8 Claims, 2 Drawing Sheets

TUMBLER APPARATUS

RELATED APPLICATION

This application claims the benefit of U.S. Provisional Application No. 60/971,323, filed on Sep. 11, 2007 and U.S. Provisional Application No. 60/971,330, filed on Sep. 11, 2007. The entire teachings of the above applications are incorporated herein by reference.

BACKGROUND

Tumbling devices are currently being marketed. These devices include various large foam devices, and various harnesses supported by guide wires and mounted to ceilings.

SUMMARY

In one embodiment, a tumbler apparatus comprises a metal roller padded with foam, a frame to give support and height to the roller and elastic bands connected at opposite ends of the roller to connect the roller to the frame. The elastic bands connect to support hooks on the frame risers.

Accordingly, an apparatus comprises a padded support member; a frame comprising a base and a pair of vertical riser members; and a pair of elastic band elements connecting the padded support member between the vertical riser members. Each elastic band element connects to one of plural support hooks spaced at different heights along the corresponding vertical riser member. The padded support member may be shaped as a cylinder and comprises a roller padded with foam material.

The frame may include a pair of frame sections, each section having a horizontal base support member and a vertical riser member extending from an intermediate portion of the base support member, and at least one cross-beam member connected between the base support members.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 1:
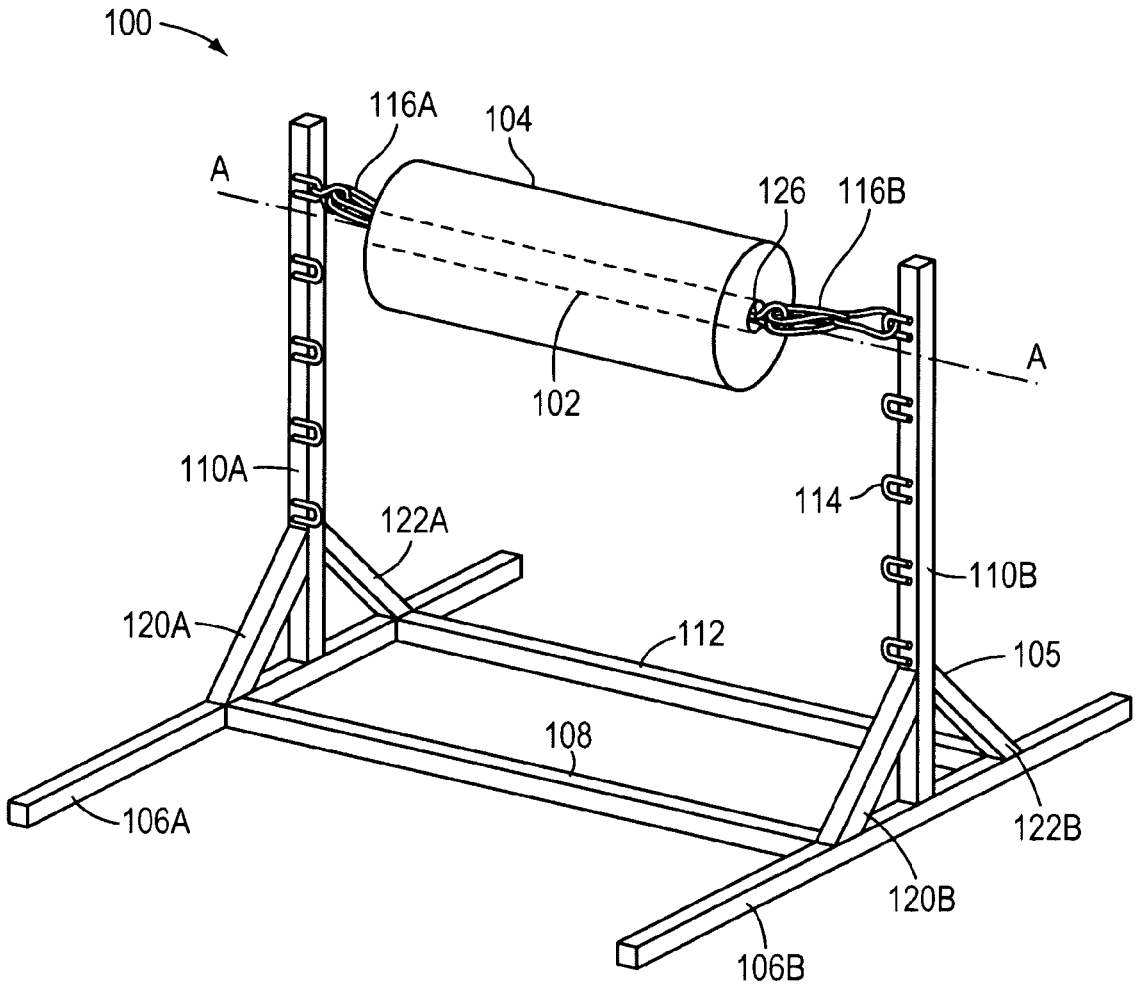
FIG. 1 is a perspective view of an example tumbler apparatus.

Referring to FIG. 1, the example tumbler apparatus 100 includes a padded support member comprising a metal roller 102 padded with foam 104, a frame 105 to give support and height to the roller and elastic bands 116A, 116B connected at opposite ends of the roller to connect the roller to the frame.

The frame 105 includes a pair of frame sections, each section having a horizontal base support member 106A, 106B and a vertical riser member 110A, 110B extending from an intermediate portion of the base support member, and at least one cross-beam member 108, 112 connected between the base support members. The vertical riser members are further supported by angled members 120A, 120B, 122A, 122B.

Figure 2:
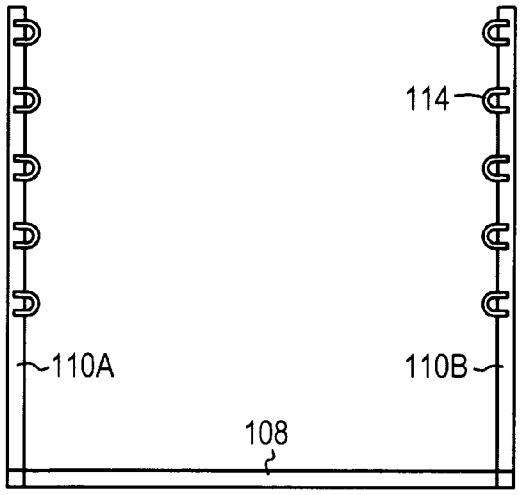
FIG. 2 is a front view of the example tumbler apparatus of FIG. 1.
Figure 3:
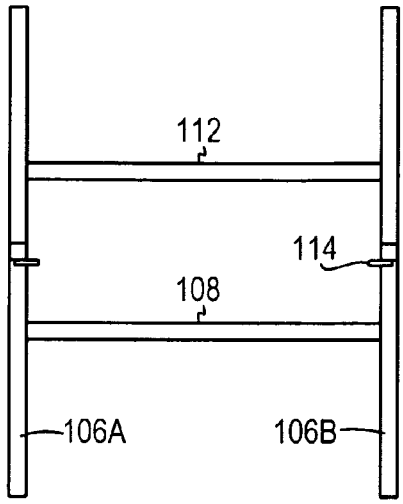
FIG. 3 is a top view of the example tumbler apparatus of FIG. 1.
Figure 4:
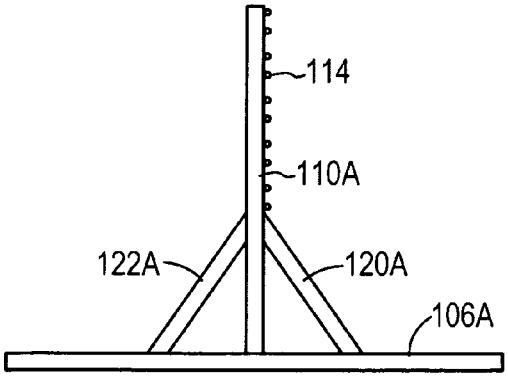
FIG. 4 is a side view of the example tumbler apparatus of FIG. 1.

The elastic bands 116A, 116B connect to support hooks 114 on the vertical riser members. The support hooks are spaced at different heights along the vertical riser members to allow for adjustment of the height of the padded roller. In an embodiment, each elastic band passes through a carabiner that is attached to a corresponding support hook. In an embodiment, sleeves made of plastic or other suitable material may be placed over the roller and padding. Standard gym matting may be used to cover all or a portion of the frame base supports and cross-beams. FIGS. 2, 3 and 4 illustrate front, top and side views, respectively, of the example tumbler apparatus.

In an embodiment, the roller 102 is a standard industrial steel or other metal roller of the type used in conveyor systems and available from CVC, Inc. The roller is cylindrical and has bearings 126 at each end that allow the roller to rotate about axis A-A. Bearings can be ball bearings, roller bearings, bushings or other suitable bearings. The padding may be made of a resilient material such as polyurethane foam or other suitable cushioning material. In an embodiment, the padding is a foam cylinder 12 inches in diameter and 24 inches in width and produced by Packaging Corporation of America. The elastic bands may be of a type manufactured by Argo Enterprises.

Figure 5A:
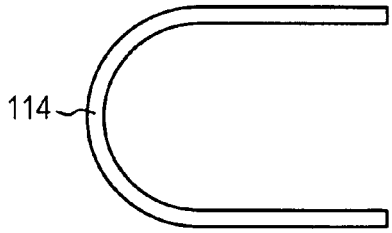
FIG. 5A illustrates a support hook for use with the tumbler apparatus of FIG. 1.
Figure 5B:
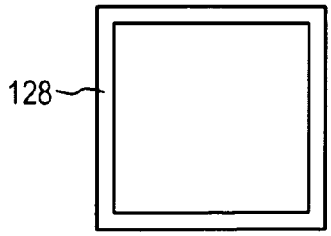
FIG. 5B illustrates a cross-section of frame tubing for use with the tumbler apparatus of FIG. 1.

FIG. 5A illustrates an example configuration of the support hook 114 for use with the example tumbler apparatus. In an embodiment, the support hook is made of round steel, though other suitable materials may be used. Other configurations may be used to attach the roller to the frame. FIG. 5B illustrates a cross-section of frame tubing for use with the example tumbler apparatus, though other configurations of framing may be used.

In operation, a tumbler stands between the frame base support members and starts to perform a tumble. The tumbler's body may contact the padded roller which gives support to the tumbler. As the tumbler's weight is applied to the roller, the elastic bands that connect the roller to the frame stretch and provide spring to the tumbler (similar to having a coach spot the tumbler). The roller rotates about axis A-A with movement of the tumbler over the padded roller. Both the spring action of the elastic bands and the rotational action of the roller help the tumbler to complete the tumbling movement.

The example tumbler apparatus as described features a padded support element that comprises a roller 102 padded with foam 104. In other embodiments, the padded support member may comprise a foam structure without a roller, in which case the foam structure relies on the elastic bands to provide a measure of rotational action in addition to providing spring action. The padded support member may also have different shapes in addition to the cylindrical shape shown in FIG. 1.

Some advantages of the apparatus are that it allows a person to perform tumbling without requiring a spotter; it provides a safe and efficient tool for teaching tumbling to people of various ages, heights, and skill levels; it provides a stand alone teaching tool; it is designed to allow for a high rate of repetition of exercises; it helps teach proper form and technique while learning to tumble; it allows people to practice their tumbling independently.

While this invention has been particularly shown and described with references to example embodiments thereof, it will be understood by those skilled in the art that various changes in form and details may be made therein without departing from the scope of the invention.

What is claimed is:

1. Apparatus comprising:

a padded support member having bearings at opposing ends the bearings comprising: at least one of a ball bearing, roller bearing and a bushing that allow the padded support member to rotate about an axis;

a frame comprising a base and a pair of vertical riser members; and a pair of elastic band elements connecting the padded support member between the vertical riser members.

2. The apparatus of claim 1 in which each elastic band element connects to one of plural support hooks spaced at different heights along the corresponding vertical riser member.

3. The apparatus of claim 1 in which the padded support member is shaped as a cylinder.

4. The apparatus of claim 1 in which the padded support member comprises a roller padded with foam material.

5. Apparatus comprising:

a padded roller having bearings at opposing ends that allow the roller to rotate about an axis;

a frame comprising a pair of frame sections, each section having a horizontal base support member and a vertical riser member extending from an intermediate portion of the base support member, and at least one cross-beam member connected between the base support members; and a pair of elastic band elements having first ends connected at opposite ends of the roller and second ends connected to the vertical riser members.

6. The apparatus of claim 5 in which each elastic band element connects to one of plural support hooks spaced at different heights along the corresponding vertical riser member.

7. The apparatus of claim 5 in which the roller is padded with foam material.

8. The apparatus of claim 7 in which the foam material is shaped as a cylinder that surrounds the roller.

* * * * *